US005833111A

United States Patent [19]

Martineau

[11] Patent Number: 5,833,111

[45] Date of Patent: Nov. 10, 1998

[54] FOLDABLE STORAGE CONTAINER

[75] Inventor: Dennis Martineau, San Antonio, Tex.

[73] Assignee: SAF-T-Box, Inc., San Antonio, Tex.

[21] Appl. No.: 937,437

[22] Filed: Sep. 25, 1997

[51] Int. Cl.[6] ..... B65D 6/22

[52] U.S. Cl. ..... 220/6; 220/7; 220/1.5; 220/4.33

[58] Field of Search ..... 220/1.5, 4.33, 220/4.28, 7, 6, 562, 622, 625, 666, 668, 693; 206/600, 386

[56] References Cited

U.S. PATENT DOCUMENTS

| | | | |
|---|---|---|---|
| D. 213,156 | 1/1969 | Detanger et al. . | |
| D. 330,089 | 10/1992 | Bunger . | |
| D. 336,152 | 6/1993 | Bunger . | |
| D. 336,157 | 6/1993 | Bunger . | |
| D. 336,158 | 6/1993 | Bunger . | |
| D. 363,162 | 10/1995 | Bunger . | |
| D. 370,780 | 6/1996 | Bunger . | |
| 3,684,122 | 8/1972 | Bonomi . | |
| 3,760,970 | 9/1973 | Lutz | 220/4.33 |
| 4,214,669 | 7/1980 | McQuiston | 220/1.5 |
| 4,506,798 | 3/1985 | Goutille . | |
| 4,613,053 | 9/1986 | Kimura et al. . | |
| 4,627,549 | 12/1986 | Dudding | 220/1.5 |
| 5,190,179 | 3/1993 | Richter et al. | 220/1.5 |
| 5,509,559 | 4/1996 | Okano et al. | 220/7 |

FOREIGN PATENT DOCUMENTS

| | | |
|---|---|---|
| 49892/59 | 6/1962 | Australia . |

*Primary Examiner*—Stephen J. Castellano
*Attorney, Agent, or Firm*—Conley, Rose & Tayon, P.C; Eric A. Stephenson

[57] ABSTRACT

A foldable storage container comprising a base section, a pair of side sections, a pair of end sections, and a roof. The base section includes a pair of base side rails extending laterally between ends, and a corner connector attached to each of the ends. The side sections have upper and lower side rails extending laterally between opposite ends, and pair of vertical side posts connected between the upper and lower side rails. Each end section releasably mounts to the base at opposite ends thereof. Each end section has a pair of vertically extending end posts. Coupling elements connected between the base section and the end sections releasably mount the end sections to the base section. Each coupling element comprises a locking bar fixedly connected to one of the corner connectors and a locking engagement for receiving the locking bar. The locking engagements are fixedly connected to a lower end of each vertical post.

20 Claims, 13 Drawing Sheets

FOLDABLE STORAGE CONTAINER

BACKGROUND OF THE INVENTION

1. Field of the Invention

The present invention relates generally to the art of portable storage containers, and more particularly to foldable steel storage containers.

2. Description of the Relevant Art

The advantages of portable containers for storing equipment, goods, etc., is well-known. Portable storage containers provide business owners with temporary or permanent storage space to accommodate or complement their existing storage facilities. Storage containers are easily movable to provide quick response to business owners in need of additional storage. Further, storage containers are typically formed from rigid materials and are provided with locking mechanisms to provide secure storage.

The storage containers of the prior art are generally defined by a base, a pair of side walls, a pair of end sections, and a roof. Storage containers are available in a wide variety of sizes, with lengths of 10–40 feet, typically. Prior art storage containers are generally assembled as rigid structures with the base, side walls, end sections, and roof fixedly connected to each other using well known welding techniques. Once assembled, storage containers are then transported to end users.

Notwithstanding their advantages, assembly and transportation of prior art storage containers is costly. More particularly, the components, e.g., base, side walls, end sections and roof, which form the storage container must be gathered at a site for assembly. Significant man hours and equipment must then employed to assemble the components to form the storage containers. Further, the storage container builders must have sufficient and costly assembly centers where the storage containers can be assembled and held until needed by off site end users.

Once assembled, rigid storage containers are then transported to end users often times on flatbed trucks one at a time. As noted above, once assembled, the storage containers have significant dimensions. The size limits the number of storage containers which can be transported using a single, flatbed truck. Usually, only one storage container can be moved at a time. More than one flatbed truck may be needed to transport several storage containers to a single end user site. Otherwise, several trips may be needed to transport several storage containers using a single flatbed truck. In either instance, significant transportation costs are added to the ultimate cost connected with use of storage containers of the prior art.

Collapsible storage containers are known in the art. These containers are collapsible in the sense that the components, i.e., side walls, base, end sections, and roof, are releasably connected to each other rather than being permanently welded together. Collapsible containers provide a solution to the high costs associated with transporting rigid storage containers. Namely, collapsible storage containers can be collapsed into a state with their side walls, end sections and roof stacked on the base section. Once collapsed, the storage containers can be transported, several stacked on top of each other, to an end user's remote location. Once delivered, the components are reconnected into an integrated structure. However, the prior art collapsible storage containers employ complicated and expensive devices to reconnect the various components. As a result, prior art collapsible storage containers still require significant and expensive man power to reconnect into an integrated unit.

SUMMARY OF THE INVENTION

The present invention provides a collapsible storage container which easily reconnects into a rigid structure. According to one aspect of the present invention, the collapsible storage container includes a base section, a pair of side sections, a pair of end sections, and a roof. The base section includes a pair of base side rails, a pair of base end rails, and corner connectors which connect the base side rails to the base end rails. Each of the side sections include upper and lower side rails extending laterally between opposite ends, and a pair of vertical side posts, each having an upper end connected to an upper side rail and a lower end connected to a lower side rail. A pair of end sections releasably mount to the base at opposite ends thereof. Each end section has a pair of vertically extended end posts. Coupling elements are provided to releasably connect the end sections to the base section. Each coupling element includes a locking bar fixedly connected to comer connector, and a locking engagement receiving a locking bar wherein the locking engagement is fixedly connected to a lower end of a vertical end post. In one embodiment, the locking engagement includes a rigid plate having a first end fixedly connected to the vertical post, wherein the rigid plate extends from a vertical post at an acute angle to define a groove to receive the locking bar. The corner connector generally includes four side walls connected at the respective side edges to form a unit having a square-shaped, cross-sectional configuration. The locking bar, in one embodiment, is connected between oppositely facing inner surfaces within the corner connector. The rigid plate generally has a width less than the distance between the oppositely facing inner surfaces of the corner connector which allows the rigid plate to be inserted into the comer connector so that the locking bar can be received within the groove.

According to another aspect of the present invention, the roof includes a pair of channels disposed along the roof side edges for receiving the upper side rails of the side sections. The vertical posts of the end sections are provided with channels for receiving the vertical side posts of the side sections. Further, the channels in the roof and end sections include a flange with a plurality of apertures formed therethrough. These apertures align with apertures in tabs extending from the vertical side posts and upper side rail. When the flange and tab apertures are aligned, fasteners are inserted therethrough to releasably connect the roof, right sections, and end sections.

One advantage of the present invention is that it provides a collapsible storage container which easily connects into a rigid structure.

Another advantage of the present invention is that it provides a storage container which requires significantly fewer man hours to reconnect into the ready-to-use unit.

BRIEF DESCRIPTION OF THE DRAWINGS

Other objects and advantages of the present invention will become apparent upon reading the following detailed description and upon reference to the accompanying drawings in which.

Figure 1:
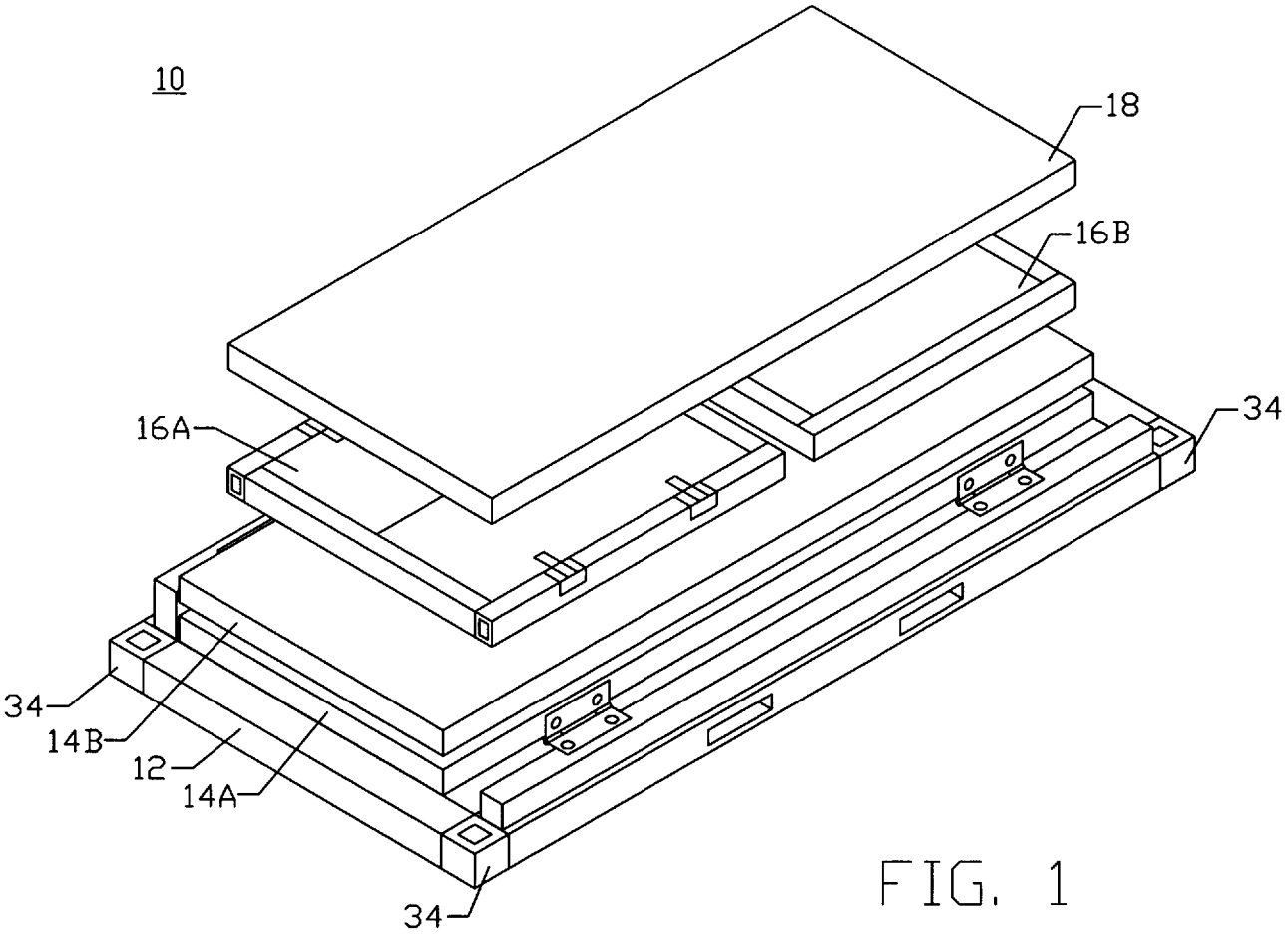
FIG. 1 is a perspective exploded view of the storage container embodying the present invention, the components of which are stacked upon each other.

While the invention is susceptible to various modifications and alternative forms, specific embodiments thereof are shown by way of example in the drawings and will be herein be described in detail. It should be understood, however, that the drawings and detailed description thereto are not intended to limit the invention to the particular formed disclosed, but on the contrary, the intention is to cover all modifications, equivalents, and alternatives falling with the spirit and scope of the present invention as defined by the appended claims.

DETAILED DESCRIPTION OF THE PREFERRED EMBODIMENTS

Reference will now be made to the figures which show a storage container embodying the present invention. It is to be understood, however, that the figures are for illustrative purposes only and are not to be construed as limiting the claims appended hereto. Further, while the figures show a limited number of embodiments, further embodiments are to be inferred from the description thereof.

FIG. 1 shows a storage container 10 unassembled or unconnected in a collapsed, transportable state. The storage container 10 includes a base section 12, a pair of side sections 14A and 14B, a pair of end sections 16A and 16B, and a roof 18.

Figure 2:
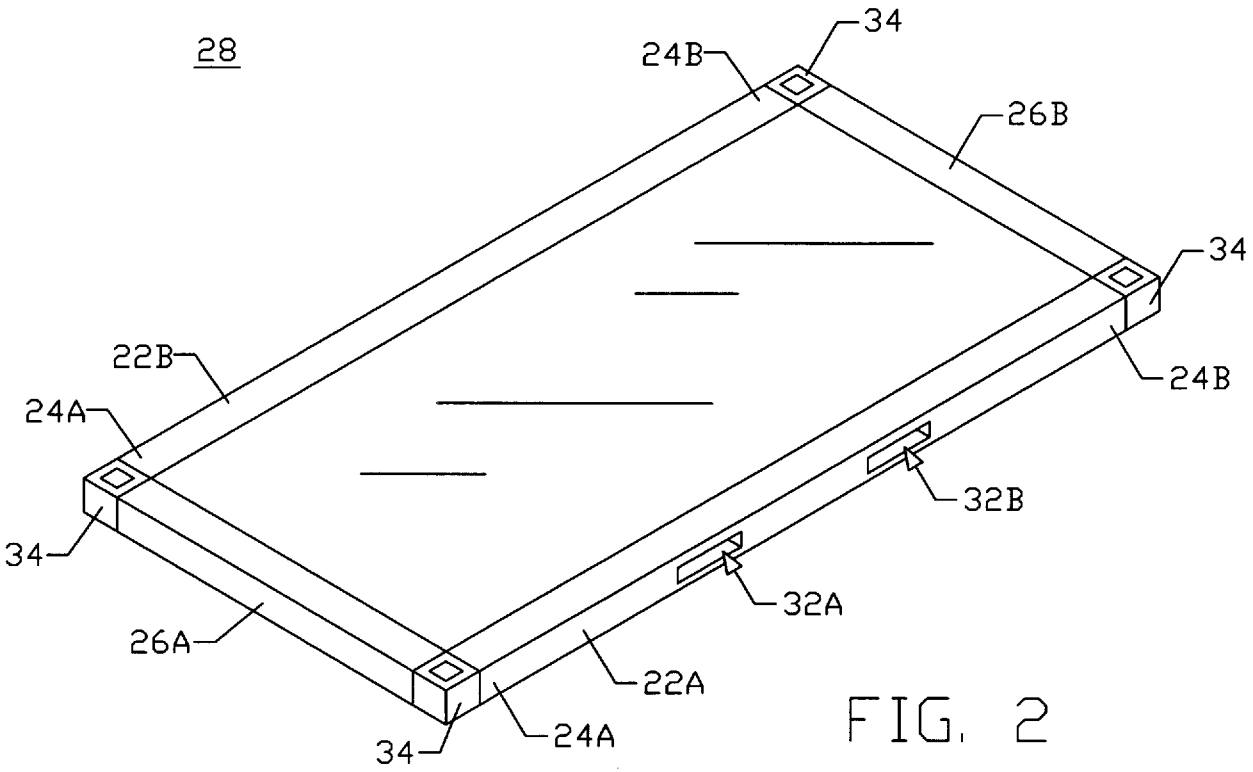
FIG. 2 is a perspective view of the base of the storage container embodying the present invention.

The base section 12, as seen in FIG. 2, includes a pair of base side rails 22A and 22B extending in parallel fashion between first and second ends 24A and 24B. A pair of base end rails 26A and 26B are connected to base side rails 22A and 22B using comer connectors more fully described below. A plurality of floor joists (not shown) extend in perpendicular fashion between base side rails 22A and 22B, and provide support for base floor 28. A pair of forklift pockets 32A and 32B extend through base side rails 22A and 22B and are configured to receive forklift forks to allow a forklift truck to lift the storage container 10, assembled or unassembled, from one position to another.

Figure 3:
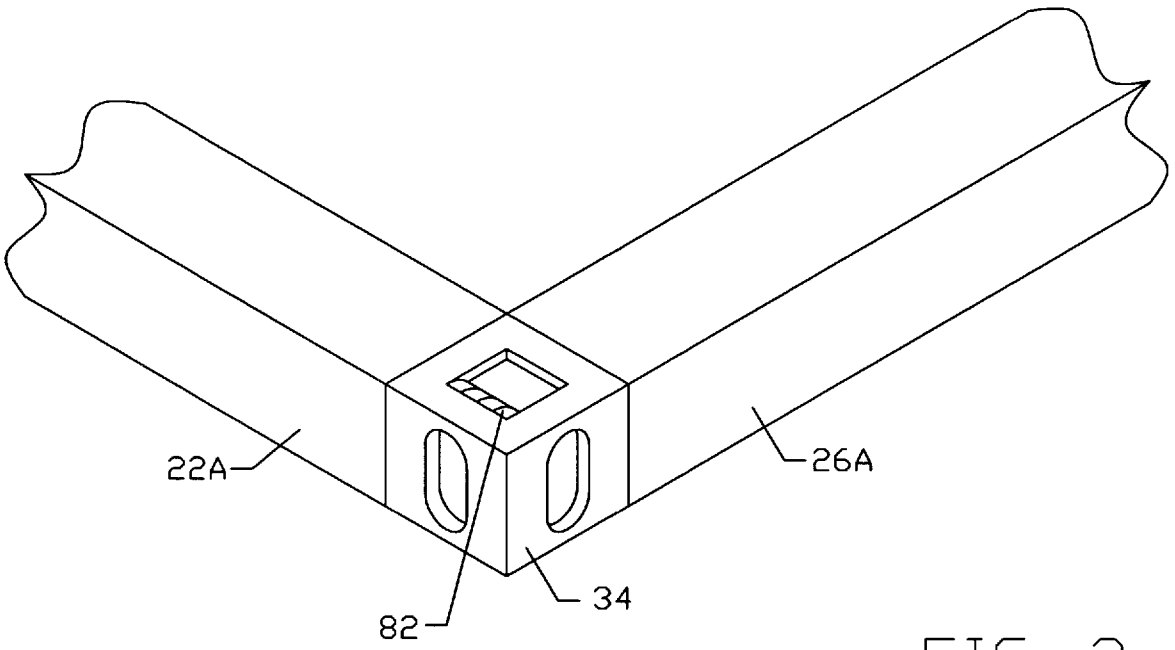
FIG. 3 is a perspective view of a corner connector attached to a side end rail of the base section.

The base side rails 22A and 22B are fixedly connected to the base end rails 26A and 26B by corner connectors 34. With reference to FIG. 3, each corner connector is formed by four side walls integrated along their side edges to form a unit with square-shaped cross-sectional configuration. Adjacent side walls of each corner connector 34 are welded, or otherwise fixedly connected to respective ends of base side rails 22A or 22B and base end rails 26A or 26B.

Figure 4:
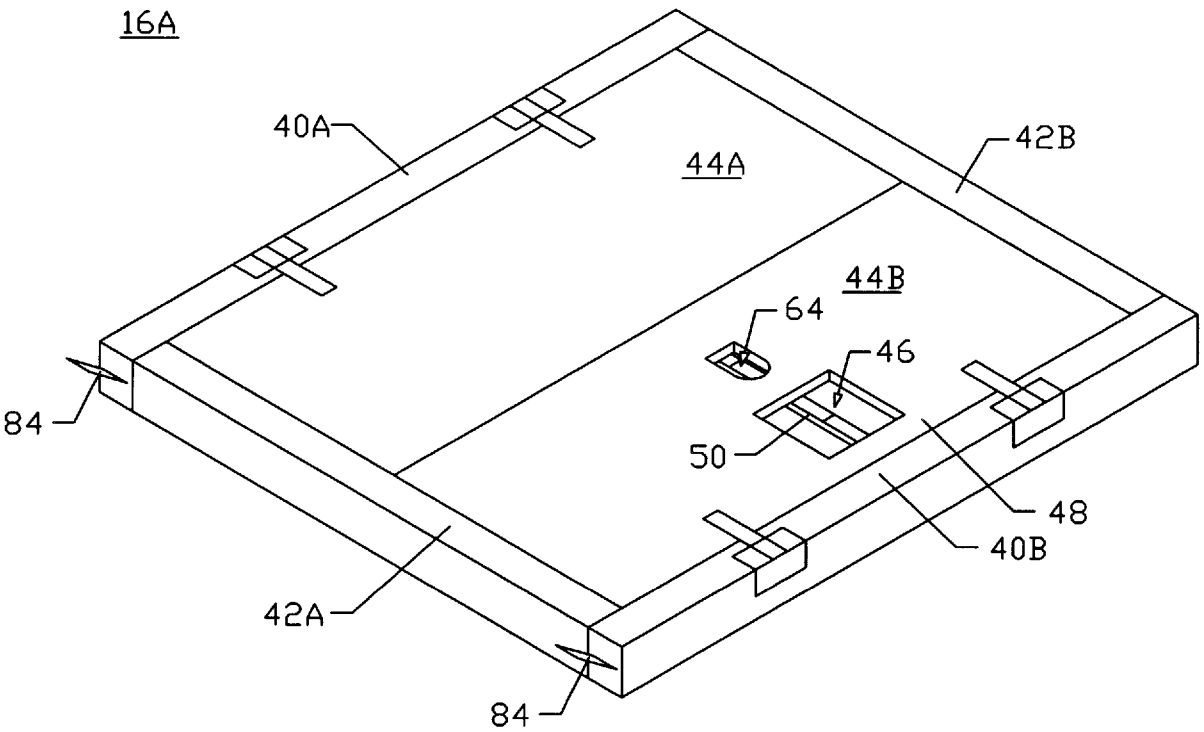
FIG. 4 is a perspective view of an end section of the storage container embodying the present invention.
Figure 5:
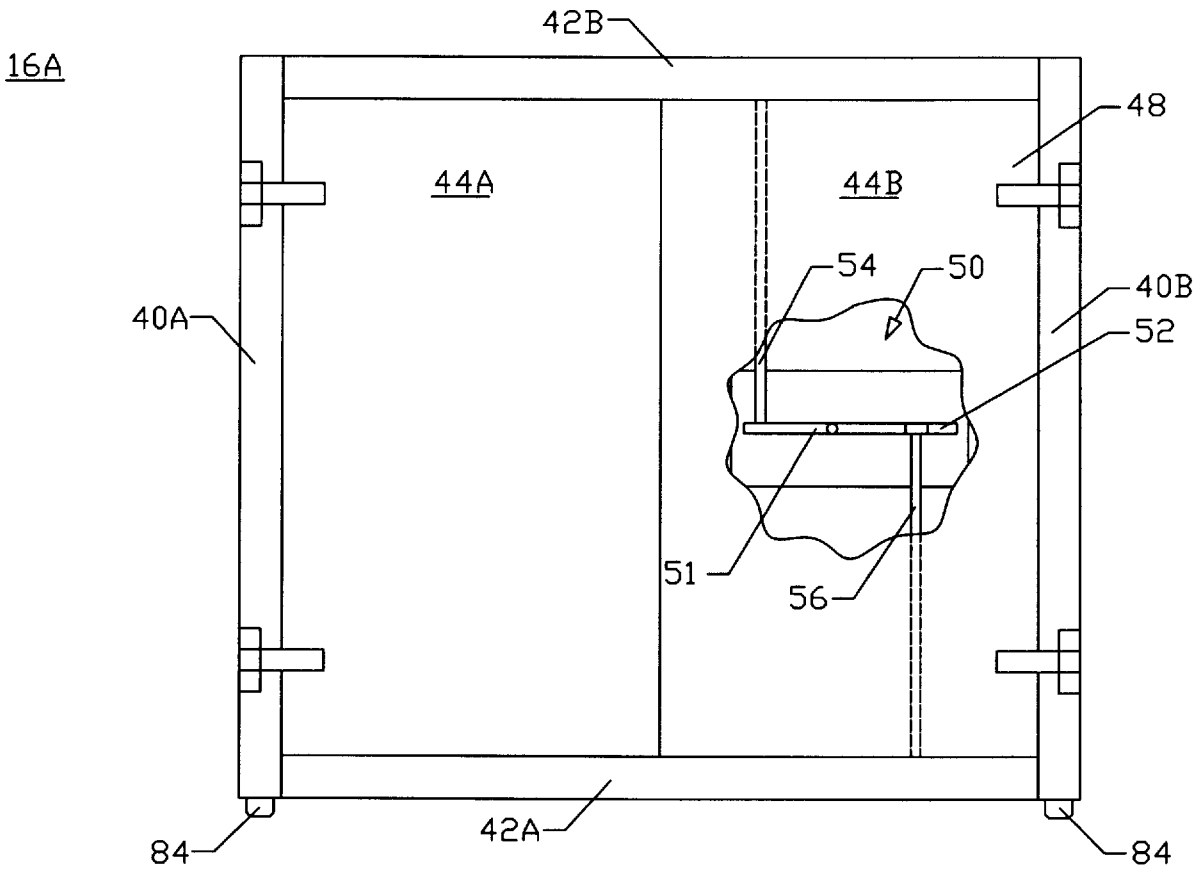
FIG. 5 is an elevational view of the end section shown in FIG. 4 with a portion removed to expose a locking mechanism.
Figure 6:
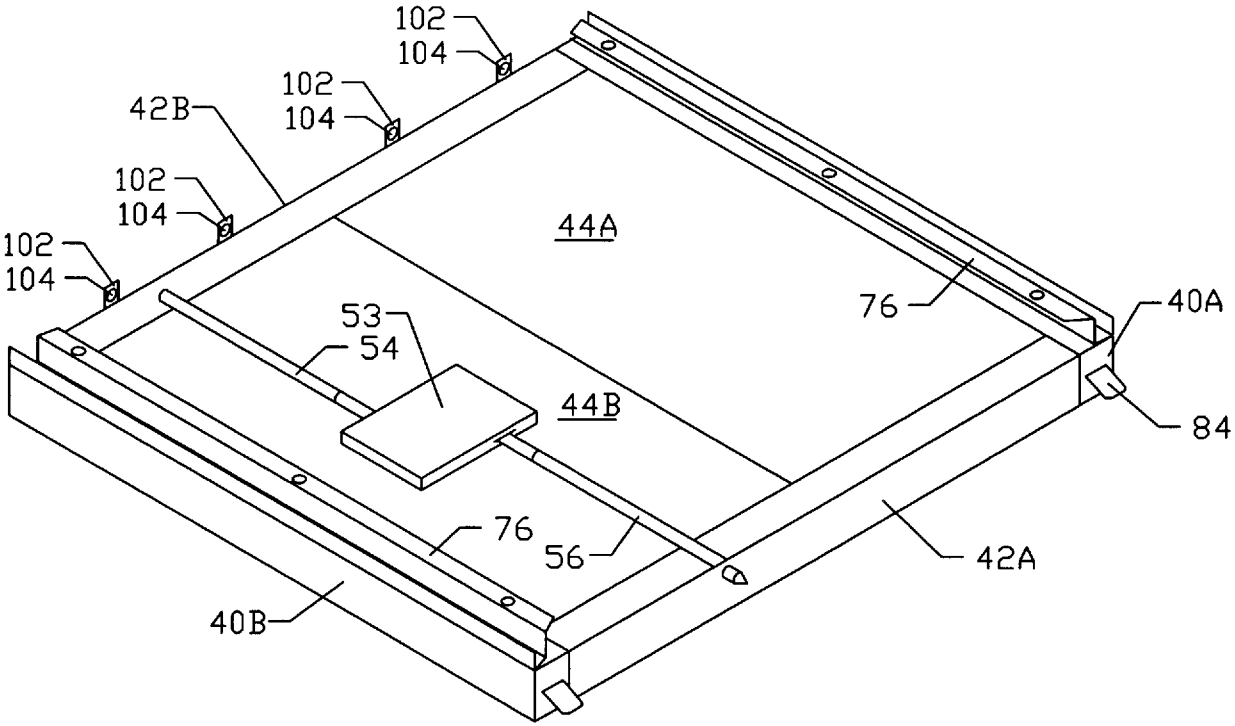
FIG. 6 is a perspective view of the reverse side of the end section shown in FIG. 4.

FIG. 4 shows one end section 16A which includes a pair of end posts 40A and 40B extending perpendicularly to a pair of parallel end section rails 42A and 42B. End section 16B (not shown) also includes a pair of end posts 40A and 40B extending perpendicularly to a pair of parallel end section rails 42A and 42B. One or both end sections 16A and 16B may include a pair of doors 44A and 44B hingedly attached to end posts 40A and 40B. For purposes of illustration, only end section 16A is shown with a pair of doors, it being understood that end section 16B can be provided with a pair of doors. At least one of the doors 44B shown in FIG. 4 is provided with a recess 46 defined in a panel 48. Recess 46 provides access to a locking mechanism 50 (not shown in FIG. 4). With reference to FIG. 5, which shows end section 16A with a portion of panel 48 cut away to expose locking mechanism 50 contained in a housing, locking mechanism 50 includes a bar 51 with integrated handle portion 52, the bar 51 being rotatably mounted near its midpoint to the locking mechanism housing in door 44B. A first rod 54 is pivotally attached to one end of bar 51, and a second rod 56 is pivotally connected to the bar 51 between opposite ends thereof. FIG. 6 shows the reverse side of end section 16A shown in FIG. 4. Housing 53 houses bar 51 and includes apertures in the upper and lower portions though which first and second rods 54 and 56 respectively extend. Rotation of bar 51 about its mount point, moves opposing ends of rods 54 and 56 in opposite directions to engage aligned latches or keepers (not shown) in the upper and lower end section rails 42A and 42B. With rods 54 and 56 engaging their respective latches, door 44B cannot be opened.

Figure 7A:
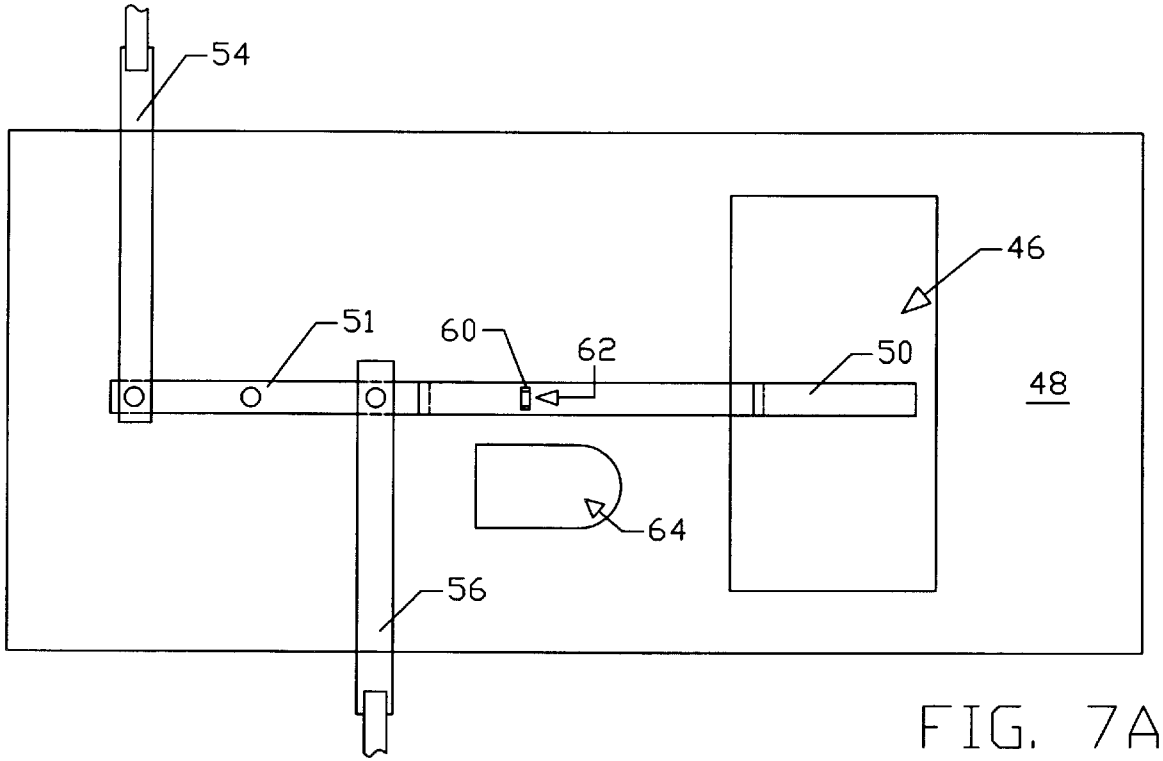
FIG. 7A presents side elevational view of a locking mechanism.
Figure 7B:
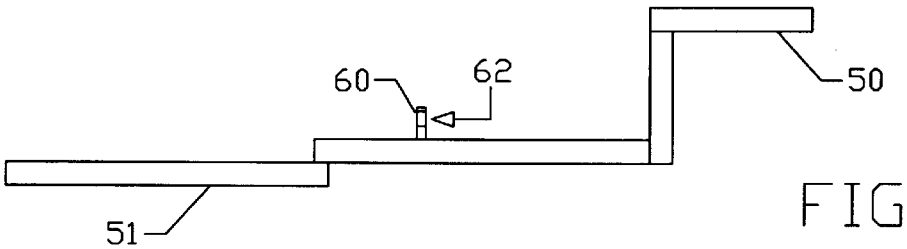
FIG. 7B is a top plain view of a locking bar employed in the locking mechanism of FIG. 7A.

With reference to FIGS. 7A and 7B which show the locking mechanism 50 and a top view of bar 51, locking mechanism 50 is also provided with a tab 60 rigidly connected to bar 51. Tab 60, like the locking bar, is formed from a rigid material such as standard grade steel, and extends perpendicularly from bar 51 at a point between opposite ends thereof. An aperture 62 is formed through tab 60 and is configured to receive a shackle of a padlock (not shown). When ends of rods 54 and 56 engage latches in the upper and lower end section rails, aperture 62 aligns with a lock recess 64 formed through panel 48. When in alignment, the padlock shackle may be inserted through aperture 62, and the padlock locked. In this position, the housing of the padlock abuts against sidewalls of the lock recess 64 to prevent subsequent movement of the padlock, bar 51, and rods 54 and 56 which engage their respective latches, thereby locking doors 44A and 44B to end section 16A.

Figure 8:
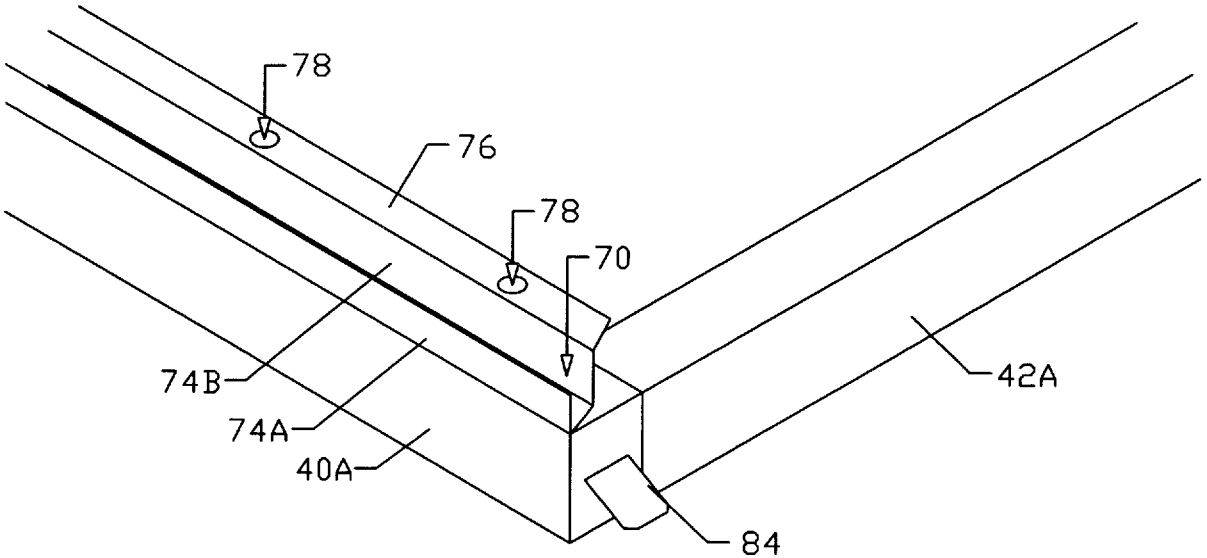
FIG. 8 is a detailed perspective view of a locking engagement attached to the end section shown in FIG. 4.

With continuing reference to FIG. 6 and with further reference to FIG. 8, each end post 40A and 40B is provided with an end section channel 70, each of which is configured to receive a side section vertical side post. For ease of illustration, only a portion of one end section 70 attached to end post 40A is shown in FIG. 8, it being understood that the other end post is likewise configured. End section channel 70 has a generally U-shaped cross-sectional configuration defined by a base section 72 and a pair of side walls 74A and 74B extending perpendicularly from the base section 72. The base section 72 is fixedly attached to and runs along the length of end post 40A. Channel 70 further includes a flange 76 extending perpendicularly from inner side wall 74B. The flange contains several apertures 78 configured to receive fasteners. As will be more fully described below, apertures 78 align with apertures in tabs extending perpendicularly from a vertical side post received in channel 70. When the apertures are aligned, fasteners are inserted therethrough to maintain the vertical side post within the channel and releasably connect the side section to the end section. Upper parallel end section rail 42A (FIG. 6) of end section 16A also includes tabs 102 with apertures 104 formed therethrough. These tabs are rigidly connected to end section upper rail and extend perpendicularly outward therefrom. The apertures 104 are configured to align with aperatures in a flange of roof 18, when the roof is mounted on the upper edges of side sections and end sections 14 and 16, and when upper end section rail 42A is received in a roof channel which will be more fully described below. When aligned, fasteners such as bolts are inserted through the roof flange apertures and apertures 104 thereby releasably securing the roof 18 to the end sections 16A.

Figure 9B:
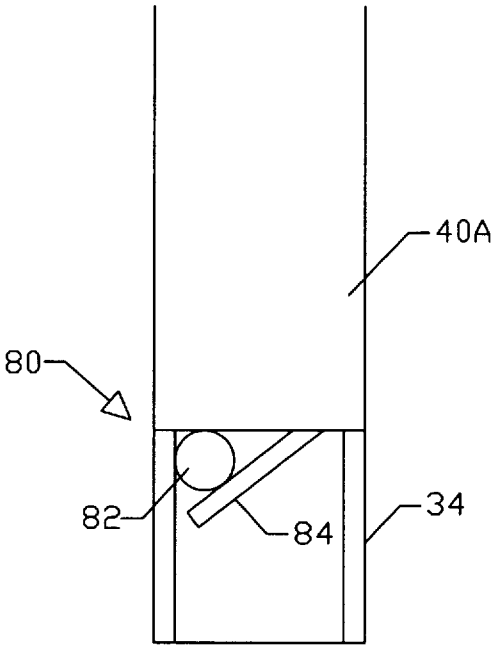
FIGS. 9A and 9B are vertical cross-sectional views of an end section as it is being mounted to the corner connector.
Figure 9A:
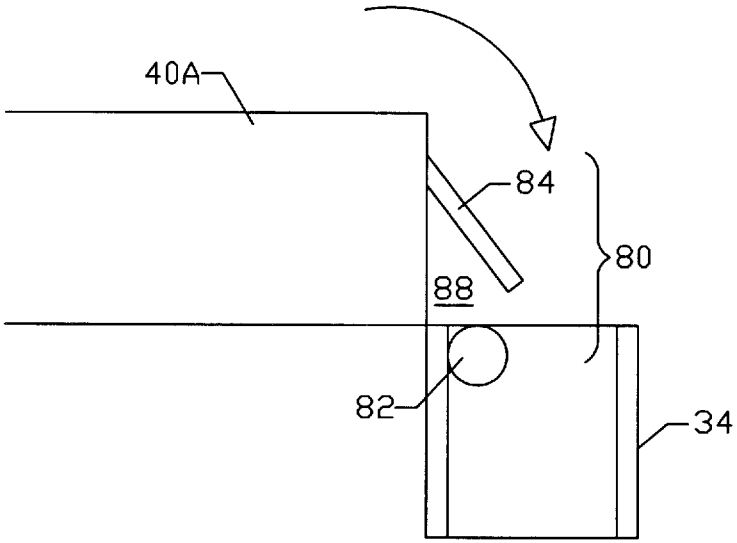

At least four coupling elements 80 are provided to releasably secure end sections 16A and 16B to base 12. Description will be made to one coupling element, as shown in FIGS. 8, 9A, and 9B, it being understood that the remaining three coupling elements are likewise configured. Coupling element 80 includes a locking bar 82 and locking engagement 84. Locking bar 82 is connected to a corner connector 34 of base section 12, while locking engagement 84 is connected to a lower end of an end post 40A or 40B. Coupling elements 80 provide a unique means by which end sections 16A and 16B may be releasably connected to section 12. Using the coupling elements of the present invention, end sections 16A and 16B can be easily and quickly attached to base 12 thereby reducing the overall cost of reconnecting the components of storage container 10 at an end user's site.

The locking engagement 84, in one embodiment, includes a rigid plate extending at an acute angle from the lower end of end post 40A or 40B, to define a groove 88 for receiving the locking bar 82. Locking bar 82 is fixedly attached within each corner connector 34 between oppositely facing inner surfaces near the upper edge thereof.

During reconnection of storage container components, lower end section rail 42B is positioned adjacent base end rail 26B as shown in FIG. 9A. Thereafter, end section 16A is rotated in a clockwise fashion until locking bar 82 is received in groove 88 of locking engagement 84 as seen in FIG. 9B. In this position, end section 16A is perpendicular to base section 12, and the locking engagement 84 acts to secure subsequent vertical movement of end sections 16A with respect to the base section 12.

Locking engagement 84 and locking bar 82 can be formed from any one of several well-known rigid materials such as standard grade steel. The locking engagement 84 should have a width which is slightly less than the distance between opposite facing inner surfaces of corner connector 34, to allow the locking engagement to be inserted in the upper opening thereof when the end section is rotated on the base during reconnection of storage container components.

Figure 10:
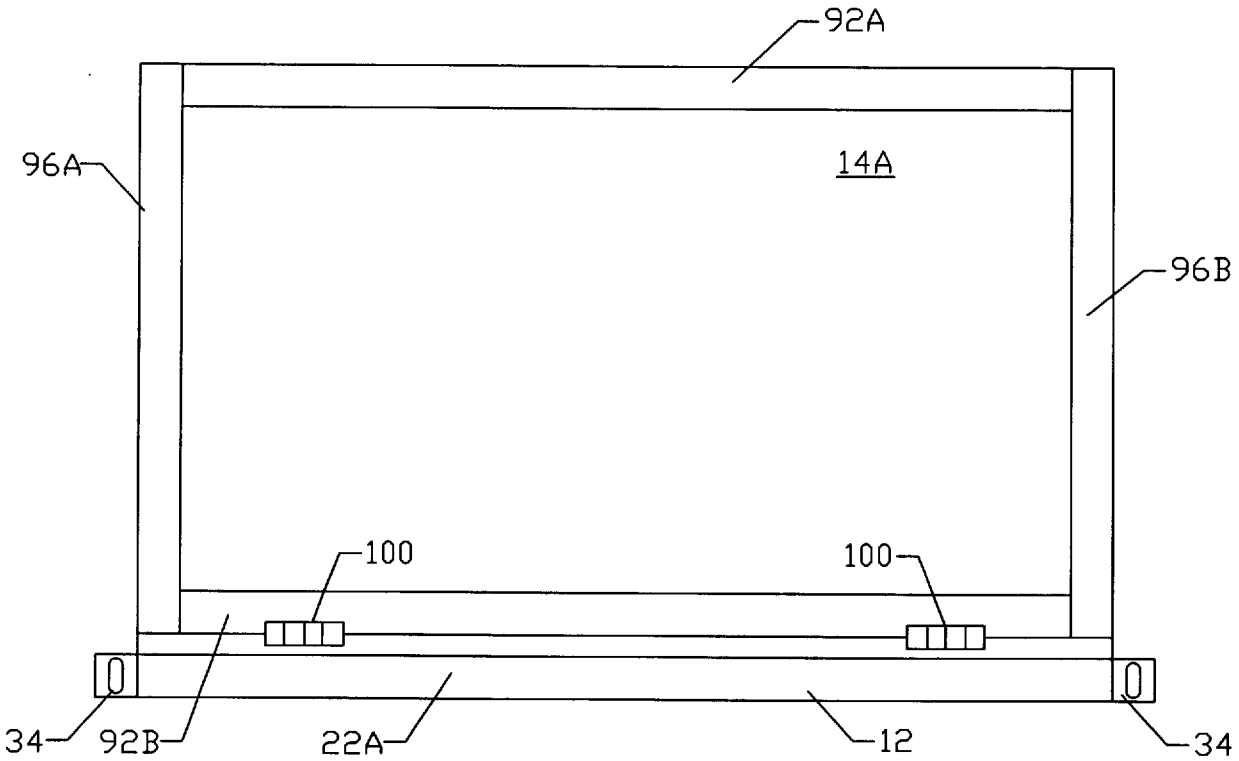
FIG. 10 is an elevational side view of a side section and base section.
Figure 11:
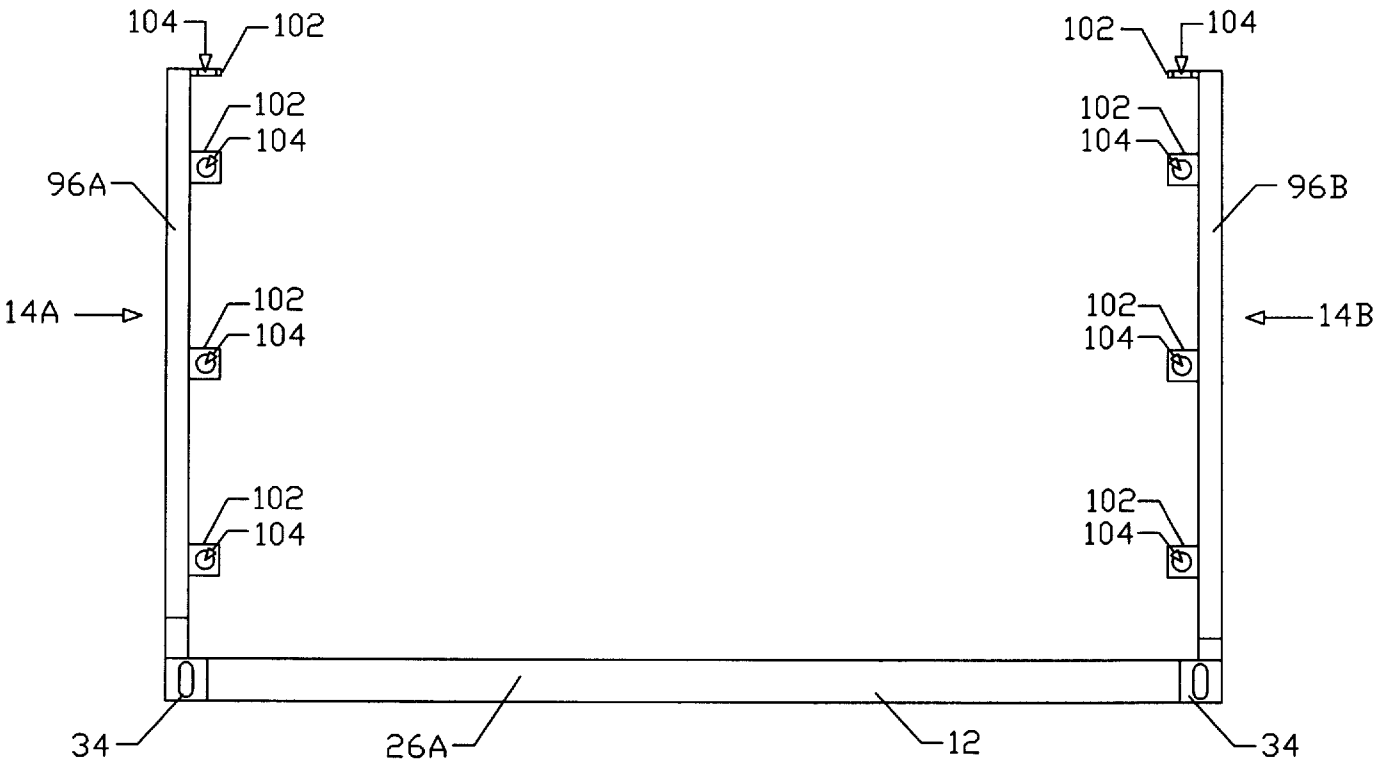
FIG. 11 is an elevational front view of the side sections and base sections.

With reference to FIGS. 10 and 11, each side section 14A and 14B includes upper and lower side rails 92A and 92B extending in a parallel fashion between first and second ends 94A and 94B. A pair of vertical side posts 96A and 96B extend perpendicularly between the side rails 92A and 92B at the first and second ends 94A and 94B. One or more side panels 98 extend between the upper and lower side rails 92A and 92B. Each lower side rail 92B is hingedly connected with at least a pair of hinges 100 to a corresponding longitudinally extending bar attached to base side rail 22A or 22B, thereby allowing side sections 14A and 14B to be easily folded onto base section 12. The width of side posts 96A and 96B are configured so that side posts 96A and 96B can be fitted within end section channels 70 and roof channels (described below) when the storage container components are reconnected. Upper side rail 92A and vertical side posts 96A and 96B are also provided with tabs 102 (FIG. 11) each having an aperture 104 formed therethrough. Each of the tabs extend perpendicularly from its respective side section toward the oppositely facing side section. During assembly of the storage container 10, tab apertures 104 of vertical side posts align with apertures 78 formed in flange 76 of end sections 16A and 16B. Thereafter fasteners, such as bolts, are inserted therethrough. The combination of vertical side posts received in end section channels 70 and fasteners extending through apertures 104 and 78, provide a simple but rigid connection between side sections 14B and end section 16B.

Figure 12:
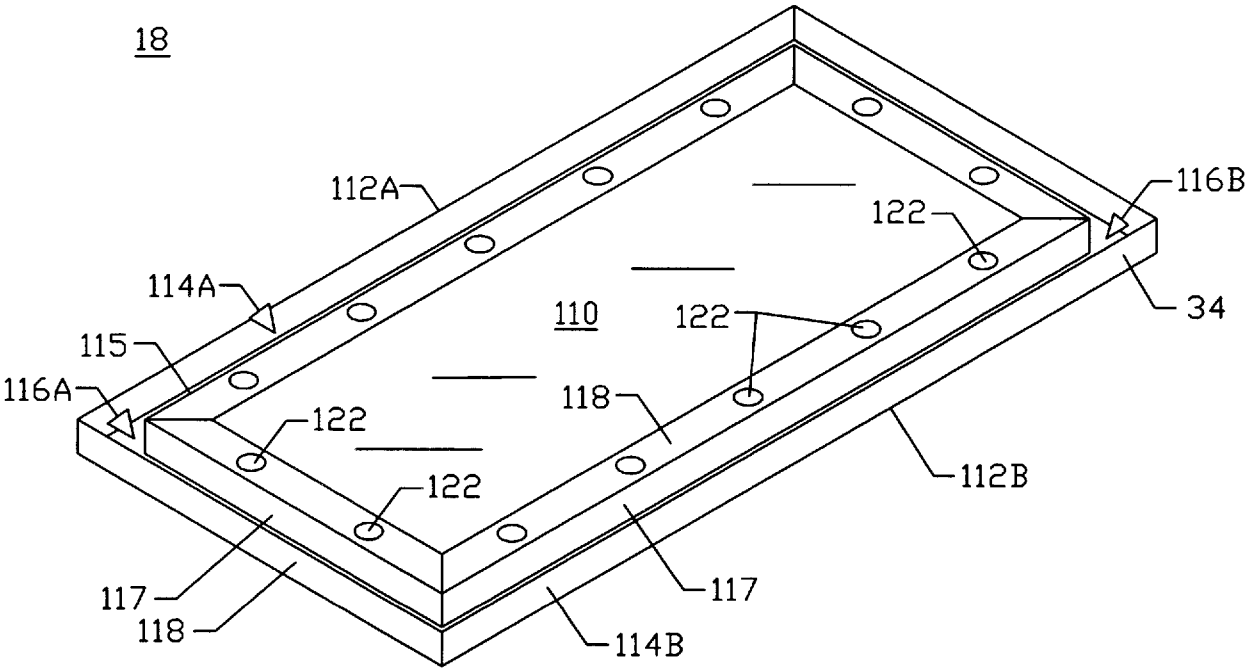
FIG. 12 is a perspective view of the underside of the roof.
Figure 13:
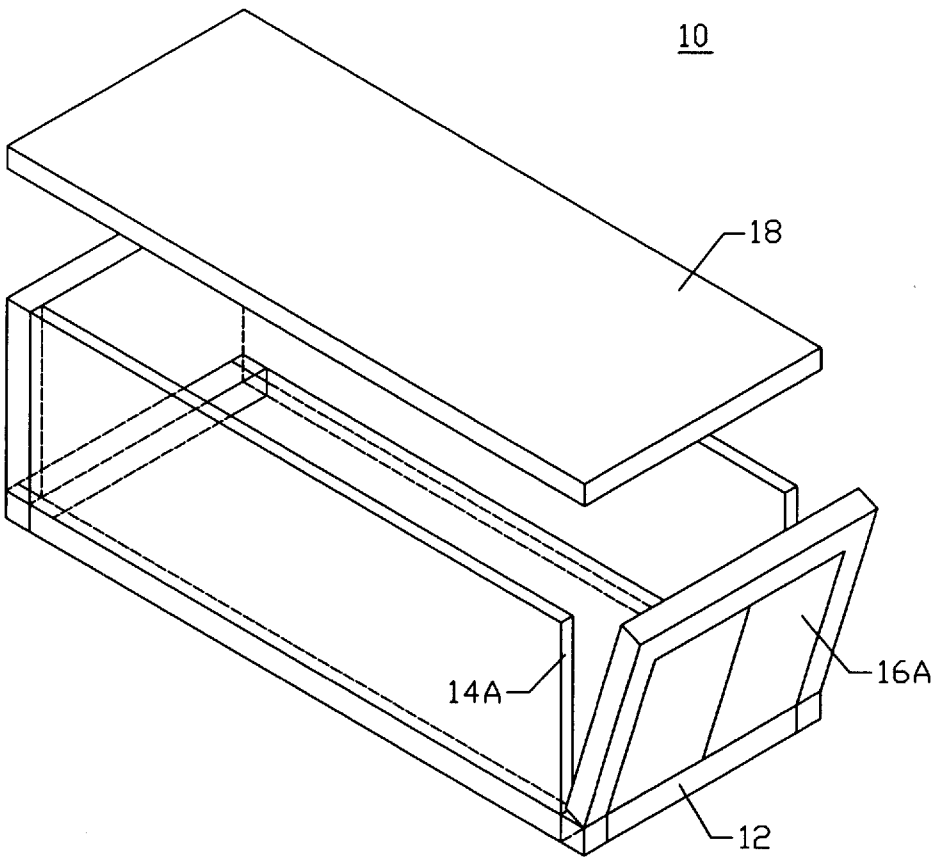
FIG. 13 is a perspective view of the roof being mounted to the end sections and side sections.

The roof 18, as seen in FIG. 12, includes one or more panels 110 extending between roof side edges 112A and 112B. The underside of roof 18 further includes a pair of side channels 114A and 114B and a pair of end channels 116A and 116B. These channels are configured to receive upper edges of side section 14A and 14B and end sections 16A and 16B. More particularly, with the end and side sections properly connected to each other and mounted on the base, the roof 18 is lowered onto the upper edges of side and end sections as see in FIG. 13 so that the roof channels receive the side and end sections. The roof channels brace the side and end sections to provide stability to the upper portions of the storage container. Each roof channel has a U-shaped cross-sectional configuration defined by a base 115 and a pair of side walls 117 extending perpendicularly from the base. Flange 118 extends perpendicularly to an inner side wall 117 of each roof channel. Flange 118 includes several apertures 122 for receiving a fastener (not shown). When the roof is lowered onto the upper edges of container 10, apertures 122 align with apertures 104 in tabs of the side sections 14A and 14B and end sections 16A and 16B. With the apertures aligned, fasteners, such as bolts, are inserted therethrough to provide further rigid connection between the roof on the one hand and side and end sections on the other hand.

Although one or more preferred embodiments of the present invention have been described in detail herein, it should be understood that various changes, substitutions, and alterations can be made therein without departing from the spirit and scope of the invention as defined by the appended claims.

What is claimed is:

1. A foldable storage container comprising:

a base section having a pair of base side rails extending laterally between first and second ends, and a corner connector attached to each of the first and second ends;

a pair of side sections each having upper and lower side rails extending laterally between opposite ends, and a pair of vertical side posts each having an upper end connected to the upper side rail and a lower end connected to the lower side rail, the lower side rail of each side section being rotatably mounted to one of the base side rails;

a pair of end sections releasably mounted to the base at opposite ends thereof, each end section having a pair of vertically extending end post,;

a roof releasably mounted to the side and end sections, and;

a first coupling means connected to a first corner connector and a first vertical end post for releasably coupling one of the end sections to the base section.

2. The foldable storage container of claim 1 further comprising:

a second coupling means connected to the roof and an upper side rail of a first side section, for releasably coupling the first side section to the roof, and;

a third coupling means connected to the vertical end post and the vertical side post, for releasably coupling the first end section to the first side section.

3. The foldable storage container of claim 1 wherein the first coupling means comprises a locking bar fixedly connected to a first corner connector and a locking engagement fixedly connected to a lower end of a first vertical post, wherein the locking engagement defines a slot for receiving the locking bar.

4. The foldable storage container of claim 3 wherein the locking engagement further includes a rigid extension fixedly connected to an end surface of the first vertical side post, the rigid extension having a first end insertable into the first corner connector to engage the locking bar.

5. The foldable storage container of claim 2 wherein the second coupling means comprises:

a pair of U-shaped channels formed on a first surface of the roof near side edges thereof, for receiving the upper side rails;

a flange fixedly connected to a side wall of one of the U-shaped channels and extending therefrom parallel to the first surface, the flange having at least one aperture for receiving a fastener;

a tab fixedly connected to a first upper side rail and extending laterally therefrom, said tab defining an aperture for receiving the fastener;

wherein the apertures of the flange and tab are in alignment, the apertures receive the fastener thereby fastening the roof to the first side wall.

6. A foldable storage container comprising:

a base section having a pair of base side rails extending laterally between first and second ends, and a corner connector attached to each of the first and second ends;

a pair of side sections each having upper and lower side rails extending laterally between opposite ends, and a pair of vertical side posts each having an upper end connected to an upper side rail and a lower end connected to a lower side rail;

a pair of end sections releasably mounted to the base at opposite ends thereof, each end section having a pair of vertically extending end posts;

at least one coupling element connected to the base section and one of the end sections, for releasably mounting the one end section to the base section, wherein the coupling element comprises a locking bar fixedly connected to a first corner connector and a locking engagement for receiving the locking bar, wherein the locking engagement is fixedly connected to a lower end of a first vertical post, and;

a roof releasably mounted to the side and end sections.

7. The foldable storage container of claim 6 wherein the lower side rail of each side section is rotatably mounted to one of the base side rails.

8. The foldable storage container of claim 7 wherein the locking engagement includes a rigid plate having a first end fixedly connected to the first vertical post, wherein the plate extends from the first vertical post at an acute angle to define a groove to receive the locking bar.

9. The foldable storage container of claim 8 wherein the corner connector includes four side walls connected at their respective side edges to define a square shaped cross sectional configuration, wherein the locking bar is connected between oppositely facing surfaces within the corner connector.

10. The foldable storage container of claim 9 wherein a side edge of the locking bar is attached to an inner surface of a first side wall at a position near an upper edge of the corner connector.

11. The foldable storage container of claim 10 wherein the plate has a width less than a distance between the oppositely facing surfaces of the corner connector to which the locking bar is connected.

12. The foldable storage container of claim 11 wherein the first vertical post includes an end surface for engaging the upper edge of the first corner connector.

13. The foldable storage container of claim 12 further comprising a hinge connected to a first base side rail and the lower side rail of a first side section.

14. The foldable storage container of claim 13 wherein the roof comprises a pair of roof channels for receiving the upper side rails, wherein a first roof channel is defined by angle iron fixedly mounted to a surface of the roof at a position near a side edge thereof.

15. The foldable storage container of claim 14 wherein a first end section includes a pair of end section channels for receiving the vertical side posts, wherein a first end section channel includes a pair of side walls extending laterally from a base to define a U-shaped channel, wherein the base is fixedly attached to a surface of one of the vertical end posts.

16. A storage container comprising:

a base section;

a pair of side sections rotatably connected to the base section;

a pair of end sections;

a roof, wherein the end sections and roof are separable for selective interconnection into an assembled unit for storing articles, and into a collapsed unit for transporting the storage container only;

wherein the base includes a pair of base side rails extending laterally between opposite ends, each end being fixedly attached to a corner connector;

wherein each side section includes lower and upper side rails, a pair of vertically extending side posts each having an upper end connected to the upper side rail and a lower end connected to the lower side rail, and;

a pair of coupling mechanisms for realeasably coupling a first end section to the base section, a first coupling mechanism comprising a locking bar fixedly attached to a first corner connector, and a clasp fixedly connected to a first vertical end post, said clasp being configured to receive the locking bar.

17. The storage container of claim 16 wherein the first end section further includes a pair of channels for receiving the vertical side rails of the side sections, each channel comprising a pair of side walls extending laterally from a base at right angles, and a flange extending from a first side wall laterally and outwardly, the flange having at least one aperture for receiving a fastener to releasably fasten a first side wall to the first end section.

18. The storage container of claim 17 wherein the first side wall includes at least one tab fixedly connected to the first vertical side post and extending laterally and outwardly therefrom, said tab defining an aperture which aligns with the at least one aperture of the flange of the first end section, wherein when the apertures are aligned, the apertures receive the fastener whereby the first end wall and first side wall are releasably attached to each other.

19. The storage container of claim 18 wherein the roof comprises a pair of channels for receiving the upper side rails, a first roof channel comprising an angle iron fixedly connected to a surface of the roof parallel to a first side edge thereof, the angle iron comprising a first section extending laterally and outwardly from the roof surface and a second section extending laterally and outwardly from the first section, the second section having at least one aperture for receiving a fastener.

20. The storage container of claim 19 wherein first side section includes at least one tab fixedly connected to the upper side rail and extending laterally and outwardly therefrom, the at least one side section tab having an aperture which aligns with the roof tab aperture to receive the fastener whereby the first side section is releasably attached to the roof.

* * * * *